United States Patent [19]

Whitaker

[11] Patent Number: 4,579,100

[45] Date of Patent: Apr. 1, 1986

[54] BALL THROWING MACHINE

[75] Inventor: Lawrence D. Whitaker, Wilmington, Del.

[73] Assignee: Athletic Engineering Corporation, Claymont, Del.

[21] Appl. No.: 709,057

[22] Filed: Mar. 6, 1985

[51] Int. Cl.[4] ..... A63B 69/40

[52] U.S. Cl. ..... 124/26; 124/32; 124/39

[58] Field of Search ..... 124/26, 54, 32, 37, 124/39; 273/129 S

[56] References Cited

U.S. PATENT DOCUMENTS

| | | | |
|---|---|---|---|
| 1,366,577 | 1/1921 | Mahern et al. | 124/26 |
| 3,128,753 | 4/1964 | Politzer | 124/32 X |
| 3,192,915 | 7/1965 | Norris et al. | 124/32 X |
| 3,265,391 | 8/1966 | Webb | 124/26 X |

FOREIGN PATENT DOCUMENTS

| | | | |
|---|---|---|---|
| 309505 | 11/1918 | Fed. Rep. of Germany | 124/26 |
| 651450 | 10/1937 | Fed. Rep. of Germany | 124/26 |
| 3001101 | 7/1981 | Fed. Rep. of Germany | 124/26 |
| 469474 | 10/1975 | U.S.S.R. | 124/26 |

*Primary Examiner*—Paul E. Shapiro

*Attorney, Agent, or Firm*—Lyman R. Lyon

[57] ABSTRACT

A machine for propelling a ball comprising an elongated barrel having an axially compressible coil spring therein that is controlled by an axially reciprocable screw disposed coaxially with and internally of said spring. A nut is threadably engaged on the screw whereby said screw is axially advanced and retracted. A coupling on the end of the screw first engages then releases said spring.

6 Claims, 7 Drawing Figures

BALL THROWING MACHINE

BACKGROUND OF THE INVENTION

1. Field of the Invention

The invention relates to a ball throwing machine for the improvement of tennis and baseball skills. In particular, it comprises a relatively simple and inexpensive machine that throws or propels a ball in a manner that simulates actual play.

2. Description of the Prior Art

Known ball throwing machines may be classified into several categories depending on the motive force utilized to propel the ball.

An example of the most popular and commercially accepted ball throwing machine is disclosed in U.S. Pat. No. 4,291,665, issued Sept. 29, 1981, to Bash et al. The Bash teaching is typical of a family of ball throwers that utilize compressed air or other gas to eject the balls from a tightly fitting barrel. Inherent problems with this design are:

(1) Extreme and unpredictable ball velocity. New balls fit tightly in the barrel, whereas old balls allow air to escape. Thus, balls are propelled at unpredictable velocity and distances.

(2) Compressed air requires relatively large amounts of power, necessitating that a high amperage source of 120 VAC power be available to the machine.

(3) The machinery is complex, requires many moving parts and is relatively heavy.

(4) Machines of this design are not easily converted to propulsion of baseballs as the stitches on a baseball preclude a sealing fit with the barrel of the machine.

Other patents in this group are U.S. Pat. Nos. 3,838,676 and 3,989,254.

Another family of ball throwing machines utilizes a spinning wheel. An example is taught in U.S. Pat. No. 4,423,717, issued Jan. 3, 1984, to Kahelin. The disadvantages common to this class of machines are:

(1) complex machinery, resulting in relatively high weight and large numbers of rapidly moving parts;

(2) the moving wheel utilizes friction to rapidly accelerate the projectiles which erodes the surface of the balls, and rapidly wears tennis balls; and (3) a substantial AC power requirement.

Other patents in this class are U.S. Pat. Nos. 3,844,267; 4,423,717; and 4,025,071.

Yet another class of ball throwing machines is represented by U.S. Pat. No. 4,269,162, issued May 26, 1981, to Abraham et al. The Abraham machine uses an arm to fling or strike the balls. As a rapidly moving arm also requires complex and expensive machinery, this design shares the disadvantages of weight, cost, power consumption, and lack of portability with each of the classes previously discussed. Other patents in this class are U.S. Pat. Nos. 3,659,576; 3,779,227; 4,237,851; 4,262,648; and 4,368,885.

Yet another class of ball throwing machines, and the one into which the present invention falls, are machines that utilize a spring to eject the ball from a barrel. For example, the patent to Pölitzer U.S. Pat. No. 3,128,753, issued Apr. 14, 1964, teaches the use of a spring driven piston wherein the spring is cocked by a motor driven cam. U.S. Pat. No. 3,807,379, to Vodinh, issued Apr. 30, 1974, teaches cocking of a spring by a solenoid. Other patents of interest in this class are U.S. Pat. Nos. 2,701,558; 2,921,574; 3,850,157; and 4,227,508.

The present invention constitutes an improvement on the aforesaid teachings.

SUMMARY OF THE INVENTION

The instant invention relates to a tennis ball or baseball throwing machine that is significantly simpler in design than the aforesaid prior art machines. The machine utilizes off-the-shelf parts which may be quickly assembled without special tools by unskilled labor. Low cost and low weight are combined with easy of operation and extreme reliability.

The tennis ball throwing machine of the present invention features a folding stand and detachable magazine to facilitate transportation in an automobile luggage compartment. Portage, erection, and operation can be accomplished by one person. The machine may be powered by a small DC motor than can be energized by a discrete battery, by connection to an automobile cigarette lighter through an extension cord or, alternatively, may be powered by a small AC motor.

The machine is readily adaptable for throwing baseballs for batting practice. No alterations or adaptions are necessary for this conversion, and the balls are ejected at a velocity substantially equal to that of a tennis ball.

DETAILED DESCRIPTION OF THE PREFERRED EMBODIMENT OF THE INVENTION

Figure 1:
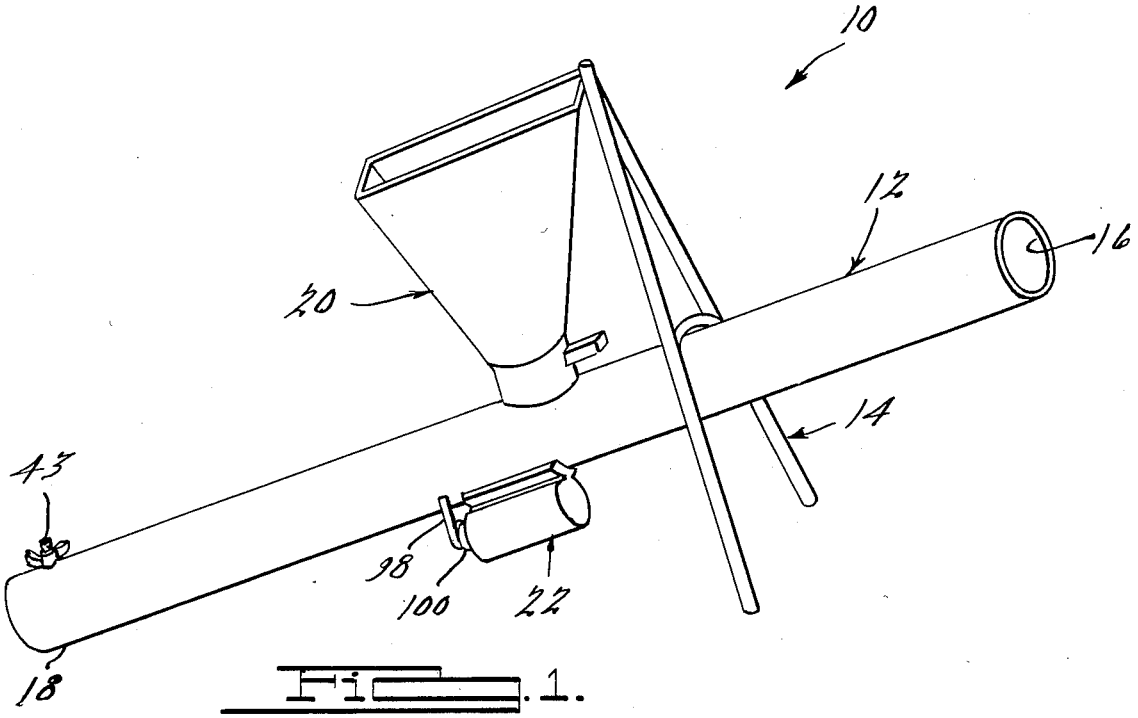
FIG. 1 is a perspective view of a ball throwing machine in accordance with the present invention.

As seen in FIG. 1 of the drawings, a ball throwing machine 10, in accordance with an exemplary constructed embodiment of the invention, comprises a barrel 12 that is supported by a triangular frame 14 so as to elevate a muzzle portion 16 of the barrel 12 relative to a lower ground contacting end 18 of the barrel 12. A ball hopper 20 is disposed intermediate the ends 16 and 18 of the barrel 12 at the top thereof so as to feed balls into the barrel by gravity. A small AC or DC motor 22 is suspended beneath the barrel 12 for drive of a spring cocking mechanism to be described.

Figure 2:
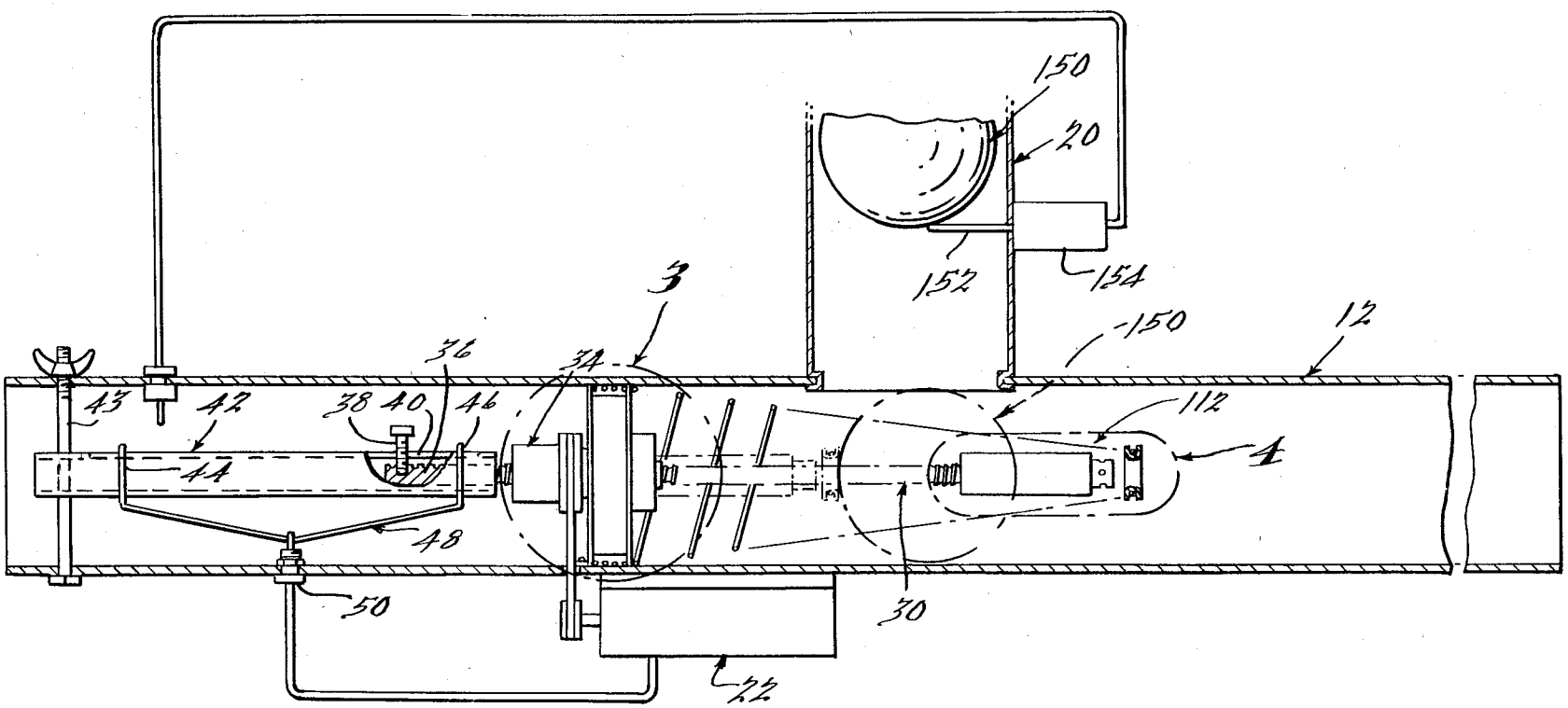
FIG. 2 is a cross-sectional view through the barrel of the ball throwing machine.

As best seen in FIG. 2 of the drawings, a helically threaded screw 30 is mounted internally of a barrel 12 by rotatable nut 34. A rear end portion 36 of the screw 30 is provided with a laterally extending pin 38 which slides longitudinally within a slot 40 in a fixed tube 42 so as to restrain the screw 30 from rotation. Thus, upon rotation of the nut 34, as will be described, the screw 30 is advanced and retracted internally of the barrel 12. Stated another way, the pin 38 precludes rotation of the screw 30 due to engagement thereof with the walls of the slot 40 in the tube 42 which is secured against rotation by a pin 43. Moreover, the pin 38 functions to engage opposite end portions 44 and 46 of a switching yoke 48 which functions to control a motor reversing switch 50, the purpose of which will be described.

Figure 3:
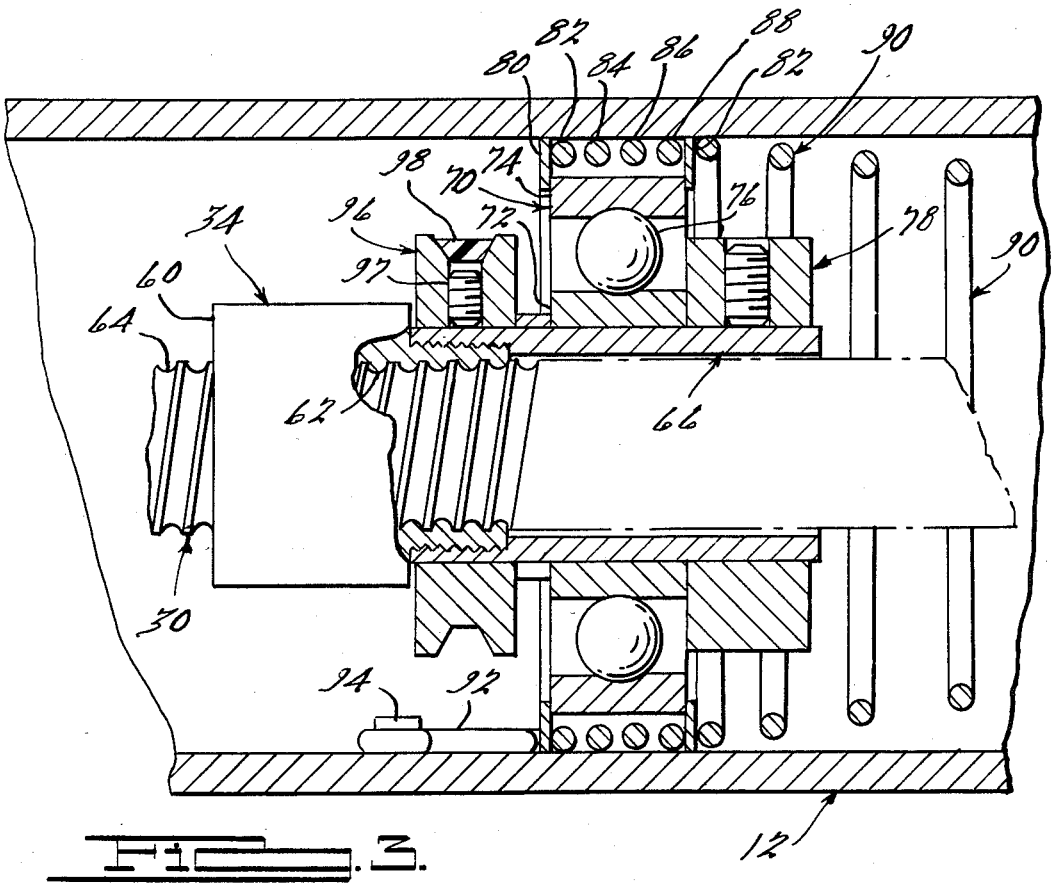
FIG. 3 is an enlarged view taken within the circle 3 of FIG. 7.

As best seen in FIG. 3 of the drawings, the nut 34 comprises a body portion 60 having an internal thread 62 complementary to the external thread 64 on the screw 30. The nut body 60 is threadably secured to a bushing or sleeve 66 which has an inside diameter slightly larger than the external diameter of the screw 30 so as to be rotatable thereabout.

The bushing 66 is positioned radially by a ball bearing 70 which comprises an inner race 72, an outer race 74, and balls 76. The ball bearing 70 is positioned longitudinally of the bushing 66 by a collar 78.

A pair of retainer disks 80 and 82 are positioned by the outer race 74 of the bearing 70 for the retention of at least four convolutions 82, 84, 86 and 88 of a helical compression spring 90. An end portion 92 of the spring 90 is secured to the barrel 12 by a pin 94 thereby to position the aforesaid assembly longitudinally of the barrel 12.

Rotation of the nut 34 relative to the nonrotatable screw 30 is effected by a sheave 96 which is drivably connected to the bushing 66 by a set screw 97. The sheave 96 accepts a belt 98 which extends to a complementary sheave 100 on the motor 22 mounted externally of the barrel 12.

As best seen in FIGS. 4–7 of the drawings, an end portion 110 of the screw 30 is provided with a spring engagement and release coupler 112. The coupler 112 comprises an inner sleeve 114 that is secured to the end 110 of the screw 30 by a pin 116. An outer sleeve 118 is telescoped over the inner sleeve 114 so as to be slidable relative thereto. A pin 120 extends through complementary apertures 122 and 124 in the outer sleeve 118, a slot 125 in the inner sleeve 114, as well as through an aperture 126 in a nosepiece 128. Thus, the nosepiece 128 is movable axially with the outer sleeve 118.

The nosepiece 128 is provided with an annular groove 130 for the acceptance of a plurality of locking balls 132. The balls 132 are contained within plurality of conical seats 134 in the inner sleeve 114. The conical seats 134 are of a dimension that permits the balls to be driven radially outwardly thereof when the nosepiece 128 moves to a position wherein the groove 130 is out of alignment with the conical seats 134. This situation can be seen in FIG. 6 of the drawings. This position of the balls 132 effects locking of the balls 132 behind a complementary grommet 140 on a looped end 142 of the spring 90.

Feed of balls 150 from the magazine 20 into the barrel 12 is controlled by a gate 152 that is controlled by a solenoid 154. The solenoid 154 is energized by a switch 155 which is engaged by the pin 38 on the screw 30 at a point in the spring retraction cycle whereat the coupler 112 and spring 90 is substantially fully retracted.

Figure 4:
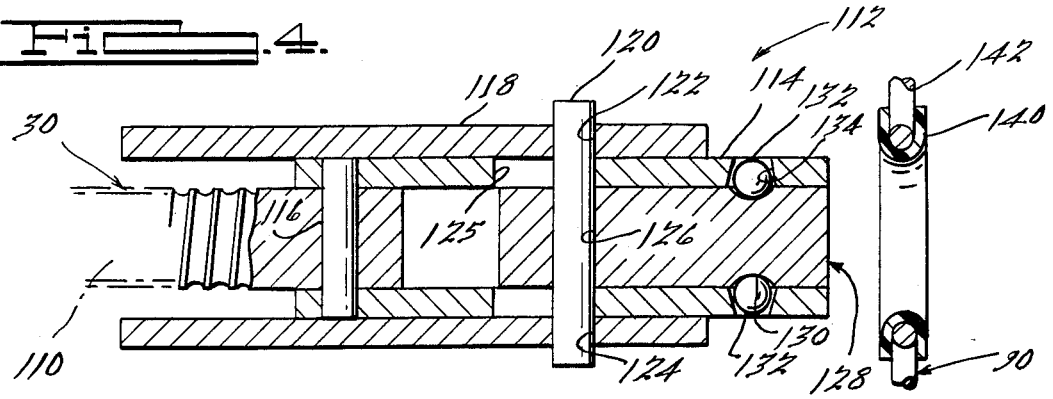
FIG. 4 is a view taken within the circle 4 of FIG. 2.

The ball throwing machine 10 of the instant invention is shown in FIG. 2 of the drawings at a point in the operating cycle wherein the coupler 112 is about to engage the grommet 140 in the looped end 142 of the spring 90. As seen in FIG. 4, the balls 132 are retracted into the annulus 130 to permit the inner sleeve 114 to pass through the grommet 140.

Figure 5:
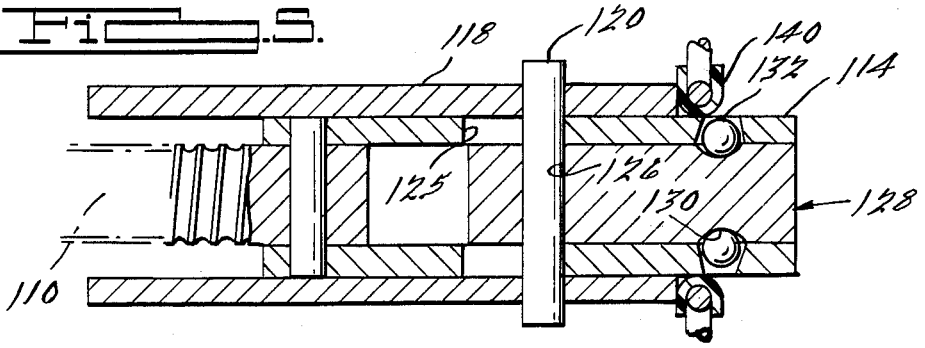
FIG. 5 is a view similar to FIG. 4 after advancement of the retraction mechanism through the propulsion spring.
Figure 6:
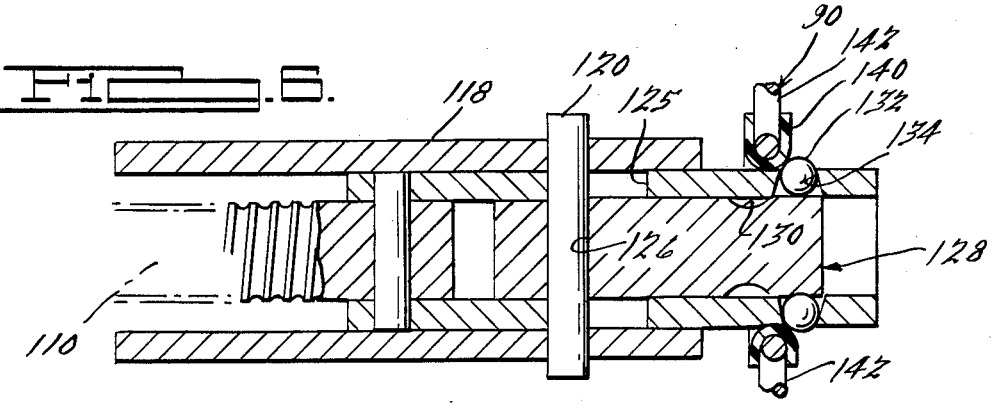
FIG. 6 is a view similar to FIG. 5 after engagement of the propulsion spring.

After passage of the inner sleeve 114 and balls 132 through the grommet 140, the outer sleeve 118 impacts against the grommet 140 driving the outer sleeve 118 to the left, relative to the inner sleeve 114 as seen by comparing FIGS. 5 and 6 of the drawings. As the outer sleeve 118 is moved to the left relative to the inner sleeve 114, the nosepiece 128 is also drawn to the left relative to the inner sleeve 114 forcing the balls 132 radially outwardly in their seats 134 so that they lock behind the grommet 140 and condition the screw 30 to effect compression of the spring 90.

Figure 7:
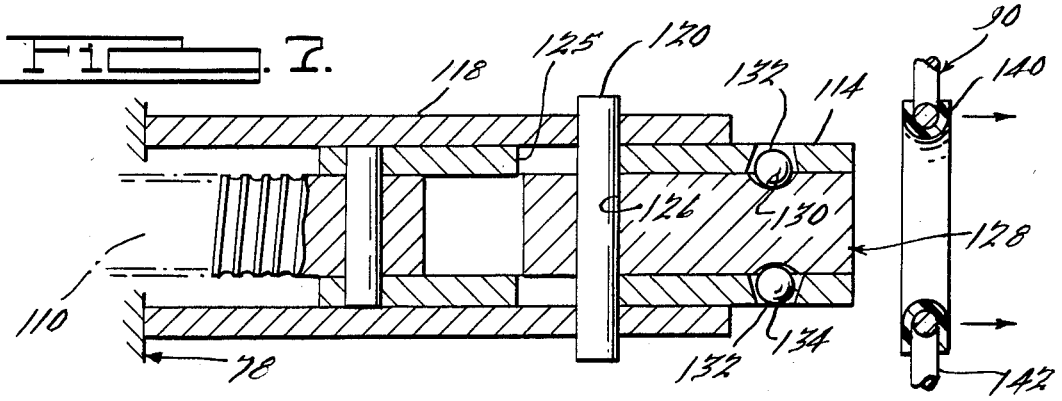
FIG. 7 is a view similar to FIG. 6 upon compression and subsequent disengagement of the propulsion spring.

At this point in the operating cycle, the pin 38 on the opposite end 36 of the screw 30 engages the end 46 of the trip yoke 48 energizing the motor 22 in the opposite direction to effect retraction of the screw 30. Retraction of the screw 30 continues until the outer sleeve 118 engages the collar 78 as seen in FIG. 7 of the drawings, thereby biasing the outer sleeve 118 and nosepiece 128 to the right relative to the end portion 110 of the screw 30 and inner sleeve 114. When the nosepiece 128 moves to the right as seen in FIG. 7, the annular seat 130 therein is brought into alignment with the balls 132 permitting the balls to move radially inwardly and release the spring 90 so as to propel a ball 150 outwardly of the barrel 12. At this point in the operating cycle, the motor 22 is again reversed due to engagement of the pin 38 with the end portion 44 of the trip yoke 48.

While the preferred embodiment of the invention has been disclosed, it should be appreciated that the invention is susceptible of modification without departing from the scope of the following claims.

I claim:

1. In a machine for propelling a ball comprising an elongated barrel, means for storing a plurality of balls over said barrel for gravity feed thereof into said barrel, and a helical compression spring in said barrel for propelling said ball outwardly of said barrel, an improved mechanism for compressing and releasing said spring comprising, an elongated screw disposed longitudinally of said barrel and coaxially with and internally of said spring, means engaged with said screw for restraining said screw from rotation, a nut threadably engaged with said screw, means for rotating said nut whereby said screw is advanced and retracting relative thereto, and coupling means on the end of said screw for engaging said spring, said engaging means including means for releasing said spring upon the occurrence of a predetermined retraction of said screw.

2. A machine in accordance with claim 1 wherein said rotating means comprises an electric motor.

3. A machine in accordance with claim 2 wherein said motor and said nut have sheaves thereon and said motor drives said nut through a V belt extending between said sheaves.

4. A machine in accordance with claim 1 wherein said spring has a hollow end portion at one end thereof and said coupling means includes means extendable therethrough.

5. A machine in accordance with claim 4 wherein said coupling means comprises an inner sleeve secured to said screw, an outer sleeve telescoped over said inner sleeve, a nosepiece controlled by said outer sleeve and disposed internally of said inner sleeve, said nosepiece having a ball accepting groove therein, and a plurality of balls carried by said inner sleeve, said outer sleeve being engageable with one side of the opening in said spring to effect radially outer movement of said balls into engagement with the other side of the opening in said spring.

6. A machine in accordance with claim 1 wherein said nut is supported by the inner race of a ball bearing, the outer race of said ball bearing being secured to said barrel.

* * * * *